US009138047B2

(12) United States Patent
Boyd et al.

(10) Patent No.: US 9,138,047 B2
(45) Date of Patent: Sep. 22, 2015

(54) ORAL CARE IMPLEMENT HAVING ROLL-ON APPLICATOR

(75) Inventors: Thomas J. Boyd, Metuchen, NJ (US); John J. Gatzemeyer, Hillsborough, NJ (US); Sharon Kennedy, Randallstown, MD (US); Eduardo J. Jimenez, Manalapan, NJ (US); Michael C. Rooney, Millburn, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 112 days.

(21) Appl. No.: 14/005,868

(22) PCT Filed: Mar. 28, 2011

(86) PCT No.: PCT/US2011/030172

§ 371 (c)(1),
(2), (4) Date: Sep. 18, 2013

(87) PCT Pub. No.: WO2012/134438

PCT Pub. Date: Oct. 4, 2012

(65) Prior Publication Data

US 2014/0010583 A1 Jan. 9, 2014

(51) Int. Cl.

| | |
|---|---|
| ***A46B 15/00*** | (2006.01) |
| *A46B 11/00* | (2006.01) |
| *A45D 34/04* | (2006.01) |

(52) U.S. Cl.

CPC ..... *A46B 15/00* (2013.01); *A46B 11/002* (2013.01); *A46B 11/0041* (2013.01); *A46B 11/0055* (2013.01); *A46B 11/0079* (2013.01); *A45D 34/041* (2013.01); *A46B 11/0017* (2013.01); *A46B 15/0081* (2013.01); *A46B 2200/1066* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,292,416 | A | | 1/1919 | Auld |
| D134,723 | S | | 1/1943 | Riksheim |
| 2,637,060 | A | | 5/1953 | Cowan |
| 2,743,042 | A | * | 4/1956 | Burgin ..... 222/191 |
| 2,800,899 | A | | 7/1957 | Barron |
| 3,296,642 | A | | 1/1967 | Aylott |
| 4,221,494 | A | | 9/1980 | Kachur |
| 4,296,518 | A | | 10/1981 | Furrier et al. |
| 4,879,781 | A | | 11/1989 | Desimone |
| 5,062,728 | A | | 11/1991 | Kuo |

(Continued)

FOREIGN PATENT DOCUMENTS

| | | |
|---|---|---|
| CN | 85203726 | 12/1986 |
| CN | 2381191 | 6/2000 |

(Continued)

OTHER PUBLICATIONS

International Search Report and the Written Opinion of the International Searching Authority issued in International Application PCT/US2011/030172 mailed Jan. 9, 2012.

*Primary Examiner* — David Walczak

(57) ABSTRACT

A fluid dispensing oral care implement (100). In one aspect, the oral care implement comprises a body (105) comprising a handle (120), a head (110) coupled to the handle, and an internal cavity (140, 150) containing an oral care material; and a roll-on applicator (130) rotatably mounted to the body, such that the oral care material is delivered from the internal cavity to an exposed portion of the roll-on applicator (130) due to rotation of the roll-on applicator.

20 Claims, 6 Drawing Sheets

(56) References Cited

U.S. PATENT DOCUMENTS

| | | | | |
|---|---|---|---|---|
| 5,096,319 | A | 3/1992 | Gueret | |
| D337,659 | S | 7/1993 | Lacy | |
| 5,242,233 | A | 9/1993 | Sirota | |
| 5,611,687 | A * | 3/1997 | Wagner | 433/80 |
| 5,765,573 | A | 6/1998 | Gueret | |
| 6,202,247 | B1 | 3/2001 | Lorenz, Jr. | |
| 6,926,166 | B1 | 8/2005 | Bitton et al. | |
| 6,939,071 | B1 | 9/2005 | Breidenbach et al. | |
| 7,172,360 | B2 | 2/2007 | McSweeney et al. | |
| 7,651,292 | B2 | 1/2010 | Tavares da Silva | |
| 8,714,853 | B2 | 5/2014 | Sutcliffe et al. | |
| 2002/0073496 | A1 | 6/2002 | Kim | |
| 2004/0237226 | A1 | 12/2004 | Hohlbein et al. | |
| 2004/0255416 | A1 | 12/2004 | Hohlbein | |
| 2005/0000049 | A1 | 1/2005 | Hohlbein | |
| 2005/0002726 | A1 | 1/2005 | Bostal | |
| 2006/0133885 | A1 | 6/2006 | Kaminski | |

FOREIGN PATENT DOCUMENTS

| | | |
|---|---|---|
| CN | 1849962 | 10/2006 |
| EP | 0 290 873 | 11/1988 |
| WO | WO01/45573 | 6/2001 |
| WO | WO 2009/157932 | 12/2009 |

* cited by examiner

ORAL CARE IMPLEMENT HAVING ROLL-ON APPLICATOR

CROSS-REFERENCE TO RELATED PATENT APPLICATIONS

The present application is a U.S. national stage application under 35 U.S.C. §371 of PCT Application No. PCT/US2011/030172, filed Mar. 28, 2011, the entirety of which is incorporated herein by reference.

FIELD OF THE INVENTION

The present invention relates generally to oral care implements, and more specifically to oral care implements having an oral care material contained therein.

BACKGROUND OF THE INVENTION

Toothbrushes are typically used by applying toothpaste to a bristle section followed by brushing regions of the oral cavity, e.g., the teeth, tongue and/or gums, with the bristle section. Some toothbrushes have been equipped with internal reservoirs and systems for delivering auxiliary oral care materials, such as whitening agents, breath freshening agents and others to a user's oral cavity, in addition to dentifrice. However, in known toothbrushes having oral care material contained therein, the delivery mechanism or channels may become clogged. Such toothbrushes do not adequately deliver the oral care material to a user's oral cavity and can force a user to spend time unclogging the device. Furthermore, some delivery systems utilize either a pump to force the fluid from a reservoir through an opening in a head of the toothbrush or capillary action to flow the oral care material from the reservoir to the head. A stationary applicator, such as a pad or bristles, is then used to apply the oral care material to the oral surface in such known toothbrushes. Thus, a need exists for an improved system for delivering and/or applying an oral care material contained within the oral care implement to a user's oral cavity.

BRIEF SUMMARY OF THE INVENTION

Exemplary embodiments of the invention are directed to oral care implements that have an oral care material contained therein. The oral care implement of the present invention comprises a body having a handle and a head and an internal cavity containing the desired oral care material. The oral care implement of the present invention comprises a roll-on applicator which delivers the oral care material from within the internal cavity to a user's oral surface.

In one embodiment, the invention can be an oral care implement comprising: a body comprising a handle, a head coupled to the handle, and an internal cavity containing an oral care material; and a roll-on applicator rotatably mounted to the body, such that the oral care material is delivered from the internal cavity to an exposed portion of the roll-on applicator due to rotation of the roll-on applicator.

In another embodiment, the invention can be an oral care implement comprising: a body comprising a handle, a head coupled to the handle, and an internal cavity containing an oral care material; and a roll-on applicator rotatably mounted to the body, such that the oral care material is delivered from the internal cavity to an oral surface of a user due to rotation of the roll-on applicator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
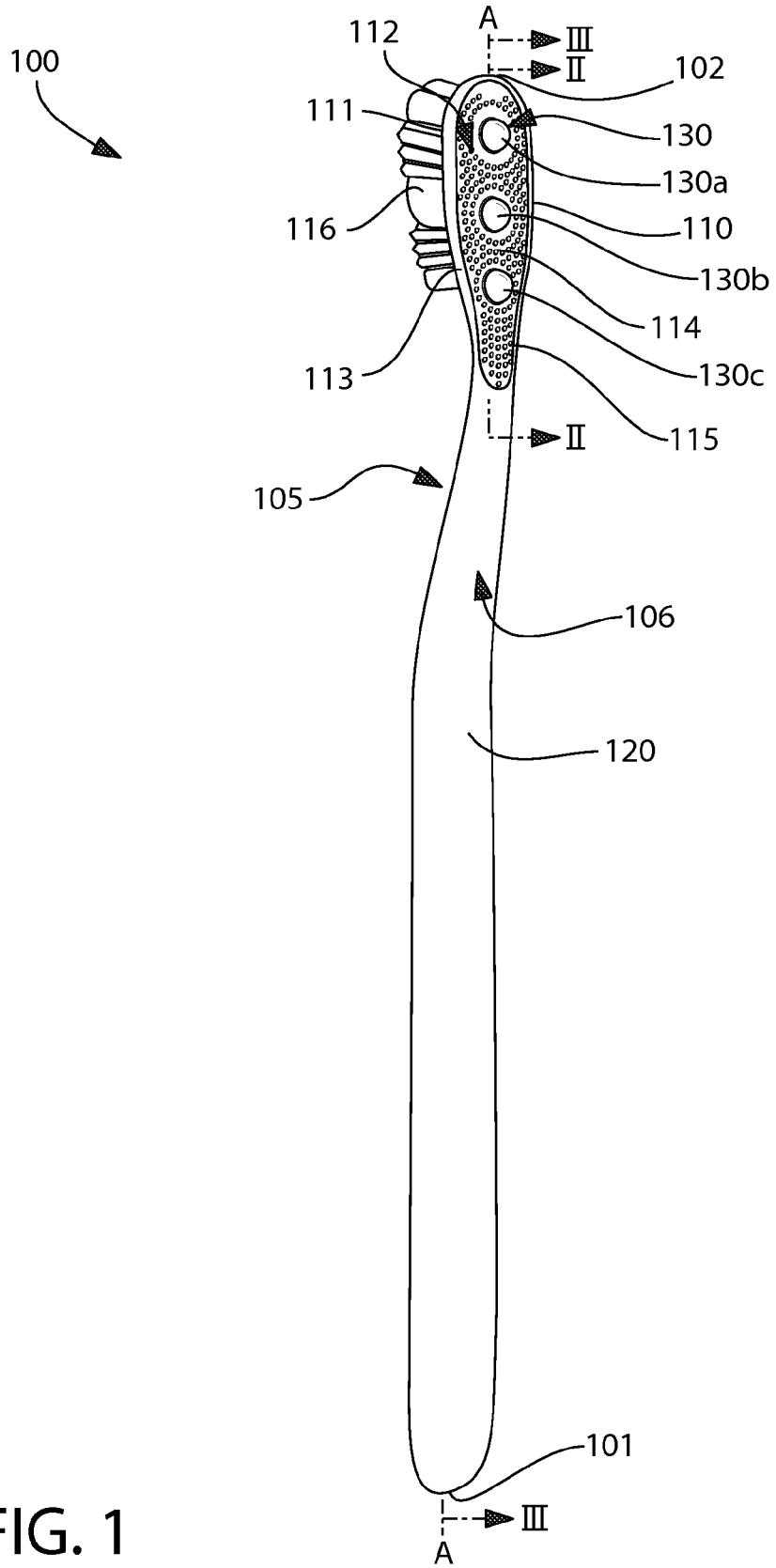
FIG. 1 is a rear perspective view of an oral care implement, in the form of a toothbrush, according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Referring to FIG. 1, a toothbrush 100 in accordance with one embodiment of the present invention is illustrated. In the exemplified embodiments disclosed herein, the invention is illustrated and described in the form of a manual toothbrush. However, the invention is not so limited in all embodiments. In other embodiments, the oral care implement may take other forms, including without limitation a powered toothbrush, an interdental device, a soft tissue cleaner or any other type of ansate oral care implement as is known in the art.

Figure 2:
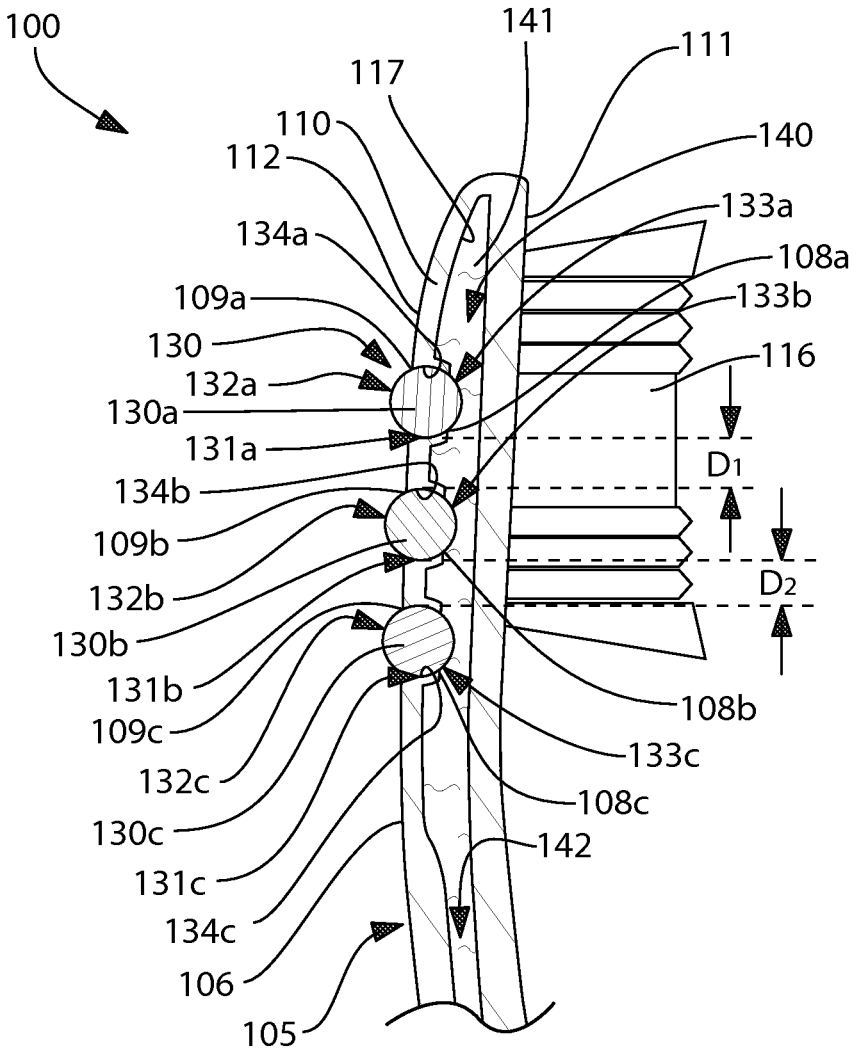
FIG. 2 is a longitudinal cross-sectional view of the head of the toothbrush of FIG. 1 taken along line II-II of FIG. 1.

The toothbrush 100 extends from a proximal end 101 to a distal end 102 along a longitudinal axis A-A. The toothbrush 100 generally comprises a body 105 having a head 110 and a handle 120. The body 105 comprises an outer surface 106 and an inner surface 117 (FIG. 2). The body 105 is constructed of a material having suitable rigidity for handling of the toothbrush 100 and being sufficiently impervious to fluids so that an oral care material, such as a fluid, can be stored within an internal cavity 140 and/or a reservoir 150 contained within the body 105 of the toothbrush 100 (discussed below). Suitable materials for the body 105 include hard plastics, such as polyethylene, polypropylene (PP), polyamide, polyester, cellulosics, SAN, acrylic, ABS or any other of the commonly known thermoplastics used in toothbrush manufacture.

The head 110 is coupled to a distal end of the handle 120. In the exemplary embodiment, the head 110 and the handle 120 are integrally formed as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 110 and the handle 120 are of a unitary or multi-piece construction (including connection techniques) is not limiting of the present invention, unless specifically claimed. In some embodiments of the invention, the head 110 may be detachable (and replaceable) from the handle 120 using techniques known in the art.

The head 110 comprises a front surface 111, a rear surface 112 and a peripheral side surface 113. The front surface 111 and the rear surface 112 of the head 110 can take on a wide variety of shapes and contours, none of which are limiting of the present invention. For example, the front and rear surfaces 111, 112 can be planar, contoured or combinations thereof. While the head 110 is normally widened relative to the neck of the handle 120, it could in some constructions simply be a continuous extension or narrowing of the handle 120.

Moreover, if desired, the rear surface 112 of the head 110 may also comprise additional structures (in addition to an applicator 130, as will be described below) for oral cleaning, such as a soft tissue cleaner 114. The soft tissue cleaner 114 is located on the rear surface 112 of the head 120 and is intended to clean a user's soft tissue surfaces such as the gums, tongue and cheeks. In one embodiment, the soft tissue cleaner 114 is formed of an elastomeric material. The elastomeric material of the soft tissue cleaner 114 may be any biocompatible resilient material suitable for uses in an oral hygiene apparatus. To provide optimum comfort as well as cleaning benefits, the elastomeric material preferably has a hardness property in the range of A8 to A25 Shore hardness. As an example, one preferred elastomeric material is styrene-ethylene/butylene-styrene block copolymer (SEBS) manufactured by GLS Corporation. Nevertheless, SEBS material from other manufacturers or other materials within and outside the noted hardness range could be used.

The soft tissue cleaner 114 comprises a plurality of protuberances, in the form of nubs 115, extending therefrom. As used herein a "nub" generally refers to a column-like protrusion (without limitation to the cross-sectional shape of the protrusion) which is upstanding from a base surface. In a general sense, the nub 115, in the preferred construction, has a height that is greater than the width at the base of the nub 115 (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

In one preferred arrangement of the soft tissue cleaner 114, the nubs 115 are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. An example of a suitable elastomeric soft tissue cleaner that may be used with the present invention and positioned on the rear surface 112 of the head 110 is disclosed in U.S. Pat. No. 7,143,462, issued Dec. 5, 2006 to the assignee of the present application, the entirety of which is hereby incorporated by reference. The soft tissue cleaner 114 is omitted from illustration in FIGS. 2-5 to prevent crowding in the figures and for ease of description. However, it should be understood that the soft tissue cleaner 114 can be included with any of the embodiments discussed herein.

In certain other embodiments, the protuberances of the soft tissue cleaner 114 can take the form of elongated ridges, nubs, or combinations thereof. Moreover, in certain embodiments, the soft tissue cleaner 114 can be formed out of the same material of the body 105 as discussed above. In one such embodiment, the soft tissue cleanser 114 can comprise protuberances that are integrally formed into the body 105.

The head 110 also comprises a plurality of tooth cleaning elements 116 extending from the front surface 111. The plurality of tooth cleaning elements 116 conceptually forms a field of cleaning elements. The tooth cleaning elements 116 are generically illustrated as a plurality of tufts of bristles. However, the invention is in no way limited by the configuration or material of the tooth cleaning elements 116. Furthermore, while the plurality of tooth cleaning elements 116 are particularly suited for brushing and/or polishing teeth, the plurality of tooth cleaning elements 116 can also be used to clean oral soft tissue, such as a tongue, gums, or cheeks instead of or in addition to teeth. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of tooth cleaning elements include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus as have been described in detail above with regard to the soft tissue cleaner 114.

The plurality of tooth cleaning elements 116 can be mounted to the head 110 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable depressions in the tuft blocks so that the base of the bristles is mounted within or below the tuft block.

Referring now to FIGS. 1 and 2 concurrently, the toothbrush 100 further comprises a roll-on applicator 130 rotatably mounted to the body 105 of the toothbrush. In the exemplified embodiment, the roll-on applicator 130 is rotatably mounted to the body 105 so as to be positioned on the rear surface 112 of the head 110 of the toothbrush 100. However, the invention is not so limited and in other embodiments (some of which will be described below), the roll-on applicator 130 can be rotatably mounted to the body 105 so as to be positioned on the front surface 111 of the head 110. In still other embodiments, the roll-on applicator 130 can be rotatably mounted to the body 105 so as to be positioned on the handle 120, such as for example at or near the proximal end 101 of the toothbrush 100. Of course, the roll-on applicator 130 can rotatably mounted to the body 105 so as to be positioned still elsewhere on the body 105, including on the narrowed neck portion of the toothbrush 100 (which is located between the handle 120 and the head 110).

In the exemplified embodiment, the roll-on applicator 130 is positioned within the soft tissue cleaner 114. In other words, the roll-on applicator 130 is positioned within a field of the protuberances of the soft tissue cleaner 114. In one embodiment, the roll-on applicator 130 is positioned within the field of the protuberances of the soft tissue cleaner 114 so as to be circumferentially surrounded by the protuberances. In still other embodiments, the roll-on applicator 130 is positioned within the field of the protuberances of the soft tissue cleaner 114 so that the protuberances of the soft tissue cleaner 114 are located on at least opposite sides of the roll-on applicator 130 measured along the longitudinal axis A-A.

In the exemplified embodiment of FIGS. 1-2, the roll-on applicator 130 comprises a plurality of rolling elements, which are illustrated as spherical elements 130*a-c*. While three rolling elements are exemplified, more or less than three rolling elements can be utilized as desired. Of course, in other embodiments, the roll-on applicator 130 may comprise a single rolling element. In the exemplified embodiment, the rolling elements are in the form of a first spherical element 130*a*, a second spherical element 130*b* and a third spherical element 130*c*. Each of the spherical elements 130*a-c* is capable of 360 degree rotation about each of the X, Y and Z axes in a Cartesian coordinate system such that there is no limit on the angle and/or degree of rotation of the spherical elements 130*a-c*. Although the rolling elements of the roll-on applicator 130 are exemplified and described herein as spherical elements 130*a-c*, the rolling elements of the roll-on applicator 130 can take on many other three-dimensional geometries so long as the rolling elements are capable of a sufficient degree of rotation to deliver oral care material from an internal cavity and/or reservoir to the user's oral surface. Thus, the structural cooperation and concepts discussed below can be applied to any type of rolling element that is used as the roll-on applicator 130.

The spherical elements 130*a-c* are solid in the exemplified embodiment but can be hollow in other embodiments. The spherical elements 130*a-c* can be formed of a wide variety of materials, including rigid materials, elastomeric materials, or combinations thereof. In certain embodiments, the spherical elements 130*a-c* can be formed of hard plastics such as polypropylene or any of the other materials described above for the body 105. Alternatively, the spherical elements 130*a-c* may be formed of a metallic material such as, for example without limitation steel, aluminum, copper or the like. In still other embodiments, the spherical elements 130*a-c* can be formed of thermoplastic elastomers having a high degree of Shore A hardness.

The outer surfaces of the spherical elements 130*a-c* are smooth in the exemplified embodiment to provide comfort to a user as well as to facilitate ease of rotation. However, in certain other embodiments, the outer surfaces of the spherical elements 130*a-c* may be roughened or may contain an irregular topography. Such embodiments may enhance the delivery of an oral care material to a user's oral surfaces as will be described in detail below.

Each one of the spherical elements 130*a-c* is rotatably mounted to the rear surface 112 of the head 110 so as to be isolated form one another. In other words, each of the spherical elements 130*a-c* can function independent of the other ones of the spherical elements 130*a-c*. Thus, if one spherical element 130*a-c* were to become clogged or incapable of rotation, the other spherical elements 130*a-c* would continue to deliver the oral care material to the desired oral surface of the user during use.

In order to rotatably mount the spherical elements 130*a-c* to the body 105, the rear surface 112 of the head 110 comprises a first socket 131*a*, a second socket 131*b* and a third socket 131*c*. The first spherical element 130*a* is rotatably mounted in the first socket 131*a*, the second spherical element 130*b* is rotatably mounted in the second socket 131*b* and the third spherical element 130*c* is rotatably mounted in the third socket 131*c*. Each one of the sockets 131*a-c* forms a passageway from the external environment, through a wall of the body 105 and into an internal cavity 140 of the body 105. As a result, each one of the sockets 130*a-c* comprises a respective opening 108*a*, 108*b*, 108*c* at the inner surface 117 of the body 105 and a respective opening 109*a*, 109*b*, 109*c* at the outer surface 106 of the body 105. When rotatably mounted within their corresponding sockets 131*a-c*, the spherical elements 130*a-c* are simultaneously exposed to both the external environment and the internal cavity 140 of the body 105. In the exemplified embodiment, a portion of each of the spherical elements 130*a-c* protrudes from the openings 108*a-c* while another portion of the spherical elements 130*a-c* protrudes from the openings 109*a-c*.

The spherical elements 130*a-c* can be rotatably mounted within the sockets 131*a-c* in a wide variety of manners so long as the spherical elements 130*a-c* are retained within the sockets 131*a-c* and capable of the desired rotation. In the exemplified embodiment, the spherical elements 130*a-c* are retained within the sockets 131*a-c* due to a geometric mating between side-wall surfaces 134*a-c* of the sockets 131*a-c* and the spherical elements 130*a-c*. More specifically, each of the sockets 131*a-c* is defined by a contoured side-wall surface 134*a-c*. These contoured side-wall surfaces 134*a-c* have a concave contour that generally corresponds to the convex contour of the outer surfaces of the spherical elements 130*a-c*. Of course, the contours are selected so as to allow for the necessary tolerance required to allow rotation. As such, the convex contour of the outer surface of each of the spherical elements 130*a-c* nests within the concave contour of the side-wall surface 134*a-c* of the corresponding socket 131*a-c*. In other embodiments, the spherical elements 130*a-c* can be rotatably mounted within the sockets 131*a-c* using an axle or pivot pins.

The spherical elements 130*a-c* are rotatably mounted on the rear surface 112 of the head 110 in a spaced apart manner. In the exemplified embodiment, the first spherical element 130*a* is spaced from the second spherical element 130*b* a first distance D1 and the second spherical element 130*b* is spaced from the third spherical element 130*c* a second distance D2 such that the first and second distances D1, D2 are the same. However, in certain other embodiments the first and second distances D1, D2 may be different in order to achieve a particular cleaning action. In the exemplified embodiment, the spherical elements 130*a-c* are aligned along the longitudinal axis A-A. Of course, the invention is not to be so limited and in certain other embodiments the spherical elements 130*a-c* can be aligned along an axis that is transverse or oblique to the longitudinal axis A-A. In still other embodiments, the spherical elements 130*a-c* could be located along an axis that is substantially parallel to but offset form the longitudinal axis A-A. In another embodiment, the spherical elements 130*a-c* may be rotatably mounted the peripheral surface 113 of the head 110. Unless specifically recited in the claims, the invention is not to be limited by the particular arrangement, number and/or positioning of the rolling elements.

The internal cavity 140 is defined by the inner surface 117 of the body 105 of the toothbrush 100. In the exemplified embodiment, the internal cavity 140 is located within the head 110 of the toothbrush 100. However, in other embodiments, the internal cavity 140 can be positioned at other locations within the body 105. For example, in other embodiments, the internal cavity 140 can be located in the handle 120 and/or the neck region of the toothbrush 100. The internal cavity 140 contains an oral care material 141 therein. Thus, the body 105 forms a housing which forms the internal cavity 140 which contains the oral care material 141. In certain embodiments, the toothbrush 100 also comprises a delivery channel 142 that places the internal cavity 140 in fluid communication with a reservoir 150 (described below). However, in certain other embodiments, the internal cavity 140 is an isolated chamber and the toothbrush 100 may not include a delivery channel 142 or a separate reservoir 150. In such an embodiment, the internal cavity 140 will act as a reservoir.

The oral care material 141 is a material that provides oral health benefits to a user upon contact with a user's oral cavity. In one embodiment, the oral care material 141 is a fluidic material. For example, in certain embodiments the oral care material 141 is a mouthwash solution that cleans the oral surfaces when applied thereto and provides the user with breath freshening benefits. In other embodiments, the oral care material 141 is a tooth cleaning solution. Of course, the oral care material 141 is not to be in any way limiting of the present invention and may include fluids having active or inactive agents that deliver therapeutic, cosmetic, experiential and/or sensorial benefits to a consumer during a tooth, soft tissue, tongue or interdental cleaning regimen. Specifically, the oral care material can be an anti-sensitivity agent, fluoride, a tartar protection agent, an antibacterial agent, an oxidative or whitening agent, an enamel strengthening or repair agent, a tooth erosion preventing agent, a tooth sensitivity ingredient, a gum health active, a nutritional ingredient, a tartar control or anti-stain ingredient, an enzyme, a sensate ingredient, a flavor or flavor ingredient, a breath freshening ingredient, an oral malodor reducing agent, an anti-attachment agent or sealant, a diagnostic solution, an occluding agent, a dry mouth relief ingredient, a catalyst to enhance the activity of any of these agents, colorants or aesthetic ingredients, arginine bicarbonate, chlorohexidine, triclosan, CPC, zinc oxide and combinations thereof. In certain embodiments, the oral care material 141 is free of a dentifrice as the oral care material 141 is intended to supplement traditional brushing of the teeth rather than supplant it.

As discussed above, the spherical elements 130*a-c* of the roll-on applicator 130 are mounted to the rear surface 112 of the head 110 within the sockets 131*a-c* on the rear surface 112 of the head 110. The spherical elements 130*a-c* are mounted to the head 110 so that a portion of each of the spherical elements 130*a-c* protrudes through the corresponding opening 108*a-c* in the inner surface 117 of the body 105 and is in contact with the oral care material 141 within the internal cavity 140. Another portion of each of the spherical elements 130*a-c* protrudes through the corresponding opening 109*a-c* in the outer surface 106 of the body 105 and is exposed to the external environment. Thus, as will be described in detail below, each of the spherical elements 130*a-c* comprises an exposed portion that protrudes form the outer surface 106 of the body for applying the oral care material to the user's oral surface. As the spherical elements 130*a-c* rotate within their respective sockets 131*a-c*, the oral care material 141 is delivered from the internal cavity 140 to the exposed portions of the spherical elements 130*a-c*.

The functional details of the spherical elements 130*a-c* will now be described with respect to the first spherical element 130*a* with the understanding that the below-discussion is equally applicable to the other two spherical elements 130*b-c* and any other structural embodiment which the rolling element may take form.

The first spherical element 130*a* comprises an exposed portion 132*a* and an internal portion 133*a*. The exposed portion 132*a* protrudes from the outer surface 106 of the body 105 (which in the exemplified embodiment is the rear surface 112 of the head 110) while the internal portion 133*a* is positioned within the internal cavity 140 and in contact with the oral care material 141 therein. It should be understood that the exposed portion 132*a* and the internal portion 133*a* of the first spherical element 130*a* are not a particular segment/area of the first spherical element 130*a* itself but are rather defined by the relative positioning with respect to the body 105 and/or external environment. Thus, the segments/areas of the first spherical element 130*a* that make up the exposed and internal portions 132*a*, 133*a* change during rotation of the first spherical element 130*a*. Moreover, during rotation of the spherical element 130*a*, the particular segment/area of the first spherical element 130*a* that forms the exposed portion 132*a* of the first spherical element 130*a* at a certain time may also form the internal portion 133*a* of the first spherical element 130*a* at a different time. As the spherical element 130*a* is rotated due to frictional contact with the oral surface, the oral care material 141 within the internal cavity 140 adheres to the segment/area of the spherical element 130*a* that is, at that time, the internal portion 133*a*. As the spherical element 130*a* continues to rotate, the segment/area of the spherical element 130*a* having the oral care material 141 adhered thereto becomes the exposed portion 132*a* of the spherical element 130*a* (at a subsequent time), thereby allowing the adhered oral care material 141 to be applied to the desired oral surface.

In the exemplified embodiment, the first spherical element 130*a* comprises an exposed portion 132*a* that protrudes from the outer surface 106 of the body 105 and an internal portion 133*a* that is in contact with the oral care material 141 within the internal cavity 140. Similarly, the second spherical element 130*b* also comprises an exposed portion 132*b* and an internal portion 133*b* while the third spherical element 130*c* comprises an exposed portion 132*c* and an internal portion 133*c*.

As set forth above, the roll-on applicator 130 delivers the oral care material 141 from the internal cavity 140 to the exposed portions 132*a-c* of the spherical elements 130*a-c* due to rotation of the spherical elements 130*a-c* during use of the toothbrush 100. The adherence of the oral care material 141 to the spherical elements 130*a-c* can be the result of the tackiness of the oral care material 141, a capillary action, and/or surface tension between the oral care material 141 and the spherical elements 130*a-c*. When a user desires to dispense the oral care material 141 from the internal cavity 140 to an oral surface, the exposed portions 132*a-c* of the spherical elements 130*a-c* are first put into contact with the desired oral surface. The toothbrush 100 is then translated. Due to the frictional engagement between the exposed portions 132*a-c* of the spherical elements 130*a-c* and the oral surface, the spherical elements 130*a-c* rotate during said translation, thereby dispensing the oral care material 141 onto the oral surface. This dispensing can occur indirectly during brushing of the teeth or be specifically intended, such as brushing of the tongue with the rear surface 112 of the head 110. The spherical elements 130*a-c* will continue to rotate throughout use of the toothbrush 100 so that fresh oral care material 141 will continually be delivered from the internal cavity 140 to the exposed portions 132*a-c* of the spherical elements 130*a-c* for application to the user's oral cavity. As discussed in above, each of the spherical elements 130*a-c* is capable of 360 degree rotation about each of the X-axis, Y-axis and Z-axis of the Cartesian coordinate system, wherein the center of the subject spherical elements 130*a-c* is considered the 0-0-0 point. However, such unlimited degrees of rotational freedom are not necessary in all embodiments of the invention. In certain embodiments, the rolling element(s) of the roll-on applicator 130 will have at least 360 degrees of rotational freedom about at least a single axis. In one such embodiment, this single axis may be substantially perpendicular to the longitudinal axis A-A of the toothbrush 100.

Figure 3:
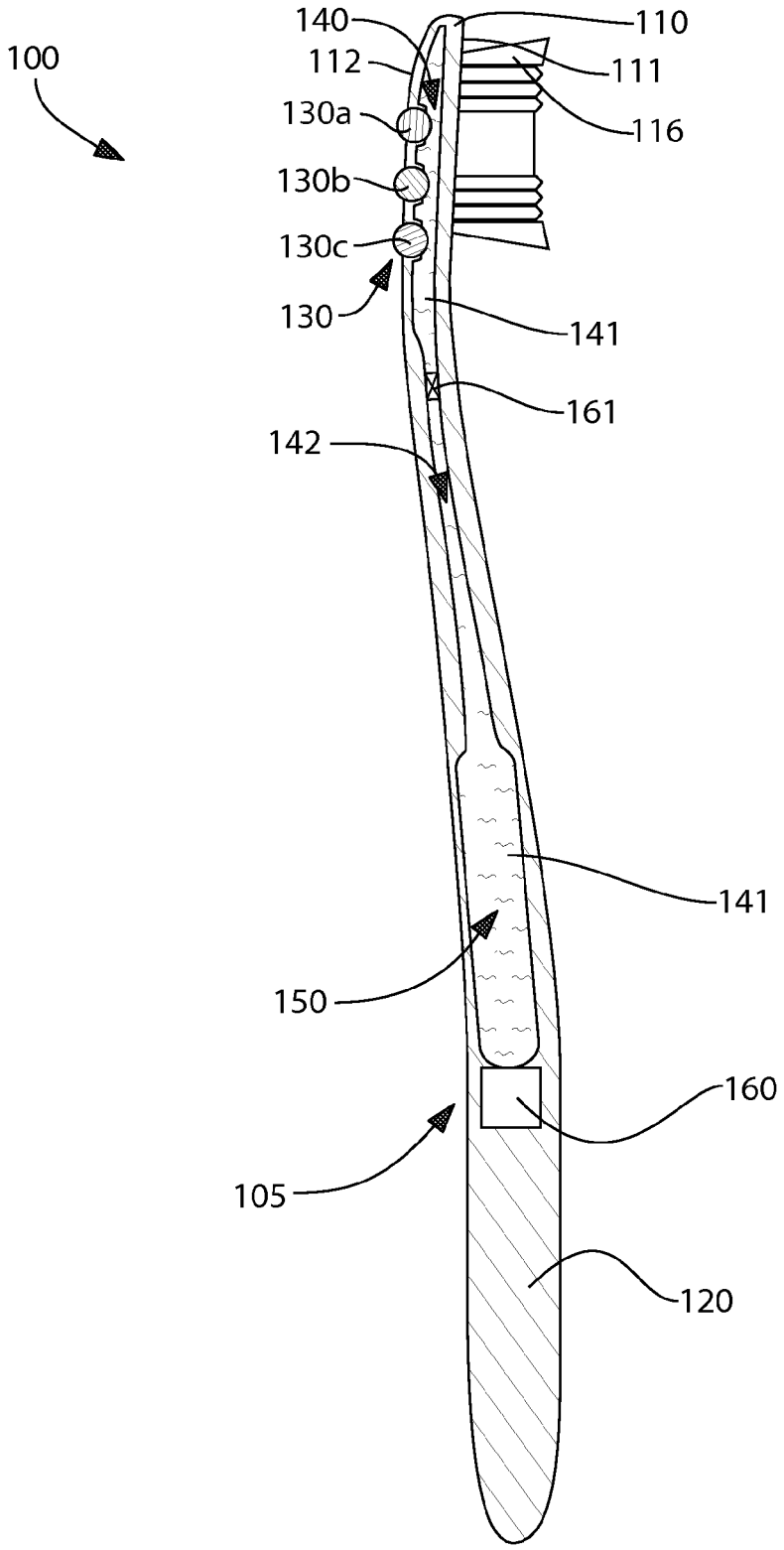
FIG. 3 is a longitudinal cross-sectional view of the toothbrush of FIG. 1 taken along line of FIG. 1, wherein a pressurizer is schematically illustrated.

Referring now to FIGS. 1 and 3 concurrently, the toothbrush 100 and its internal structure and components will be described in greater detail. In the exemplified embodiment, the body 105 further comprises a reservoir 150 that contains an additional amount of the oral care material 141. The reservoir 150 is in fluid communication with the internal cavity 140. However, as mentioned above, in certain embodiments the internal cavity 140 may be the only chamber within the body 105 that contains the oral care material 141 and, thus, can conceptually be considered a reservoir in such embodiments.

The delivery channel 142 extends from the reservoir 150 to the internal cavity 140, thereby forming a passageway from the reservoir 150 to the internal cavity 140 that facilitates the fluid communication between the reservoir 150 and the internal cavity 140. In the exemplified embodiment, the delivery channel 142 extends axially along the longitudinal axis A-A. In other embodiments, the delivery channel 142 may extend substantially transverse or at an oblique angle to the longitudinal axis A-A. The delivery channel 142 may be linear, curved, and/or combinations thereof. The exact shape and orientation of the delivery channel 142 will be dictated by considerations such as the position of the internal cavity 140, the position of the reservoir 150, and the shape of the body 105. While the internal cavity 140 is shown as being a larger chamber than the delivery channel 142 in cross-section, in certain alternate embodiments the internal cavity 140 can be merely a portion of the delivery channel 142.

The toothbrush 100 further comprises a pressurizer 160 for maintaining the oral care material 141 in contact with the spherical elements 130*a-c* of the roll-on applicator 130. In the exemplified embodiment, the pressurizer 160 is operably coupled to the reservoir 150. However, in other embodiments, the pressurizer 160 can be operably coupled directly to the internal cavity 140 or to the delivery channel 142.

The pressurizer 160 can be any type of pressurizer known in the art, such as for example without limitation a movable piston or a user-operable pump. Examples of user-operated pumps include a compressible bladder, an electrical pump, a manual pump, a gas-generating cell. The pressurizer 160 is operated by the user to increase the pressure within the reservoir 150, which in turn forces the oral care material 141 to flow from the reservoir 150 to the internal cavity 140, thereby continually supplying and filling the internal cavity 140 with the oral care material 141. Thus, by pressurizing the oral care material 141 within the reservoir 150, the pressurizer 160 also indirectly pressurizes the internal cavity 140 due to the fluid communication between the reservoir 150 and the internal cavity 140.

The pressurizer 160 ensures that the internal cavity 140 remains filled with the oral care material 141 so that the internal portions 133*a-c* of the spherical elements 130*a-c* of the roll-on applicator 130 are maintained in contact with the oral care material 141 at all times. If the internal cavity 140 becomes empty and devoid of the oral care material 141, the roll-on applicator 130 will no longer be able to deliver the oral care material 141 to the user's oral surfaces. Thus, the pressurizer 160 ensures that the internal cavity 140 remains filled with the oral care material 141 so that the roll-on applicator 130 remains in contact with the oral care material 141 for delivery.

In the exemplified embodiment, the toothbrush 100 further comprises a one-way valve 161 that is positioned in the delivery channel 142. Of course, the invention is not to be so limited and the one-way valve 161 can be positioned at other locations along the fluid path within the body 105. In one embodiment, it is simply preferred that the one-way valve be operably coupled between the reservoir 150 and the internal cavity 140. Thus, the one-way valve 161 can be positioned at an exit point of the reservoir 150 or at an entrance point of the internal cavity 140 or at any location therebetween. The one-way valve 160 permits the oral care material 141 to flow from the reservoir 150 to the internal cavity 140 while preventing or prohibiting the oral care material 141 from flowing from the internal cavity 140 into the reservoir 150. Thus, the one-way valve 161 also ensures that the internal cavity 140 remains filled so that the roll-on applicator 130 can maintain contact with the oral care material 141 within the internal cavity 140.

When the amount of the oral care material 141 within the internal cavity 140 becomes low or depleted, the oral care material 150 within the reservoir 150 can be forced into the internal cavity 140 via automated or user-operated activation the pressurizer 160. The oral care material 141 is maintained within the internal cavity 140 due to the existence of the one-way valve 161. Thus, the reservoir 150 contains an additional supply of the oral care material 141 to enable the toothbrush 100 to continue operating as desired even after an initial supply of the oral care material 141 within the internal cavity 140 has been depleted.

While the foregoing description discusses a single internal cavity 140, a single delivery channel 142, and a single reservoir 150, in certain embodiments, multiple internal cavities, multiple delivery channels, and multiple reservoirs may be provided such that different oral care materials may be provided via the spherical elements 130*a-c*.

Figure 3A:
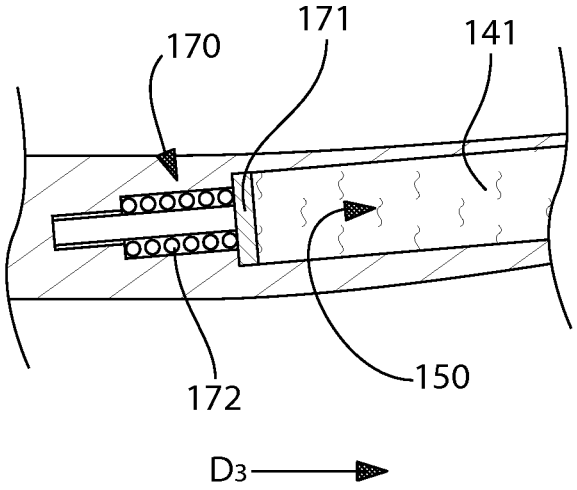
FIG. 3A is a schematic of one embodiment of a pressurizer in the form of a movable piston that can be used in the toothbrush of FIG. 1 according to one embodiment of the present invention.

Turning to FIG. 3A, one particular example of a pressurizer 170 will be described. The pressurizer 170 comprises a movable piston 171 that forces the oral care material 141 from the reservoir 150 to the internal cavity 140. In the exemplified embodiment, the pressurizer 170 includes a biasing member 172 that provides a constant pressure on the reservoir 150 and reduces the volume of the reservoir 150 as the oral care material 141 is dispensed. In the exemplified embodiment, the biasing member 172 is a coil spring. In other embodiments, the biasing member 172 can be any type of resilient component, including without limitation different types of springs, elastomeric elements, resilient prongs and/or combinations thereof. As the oral care material 141 within the internal cavity 140 becomes depleted, the biasing member 172 will extend in an axial direction D3. As the biasing member 172 extends in the axial direction D3, the piston 171 also moves in the axial direction D3 and thereby decreases the interior volume of the reservoir 150. Thus, the piston 171, which is in constant contact with the oral care material 141, forces the oral care material 141 to migrate in the axial direction D3 towards the internal cavity 140. The biasing member 172 and piston 171 only move in the axial direction D3 as the oral care material 141 is removed from the internal cavity 140 as a result of usage of the toothbrush 100. It is preferred that the force of the biasing member 172, such as the spring force, is selected so as to prevent weeping or discharge of the oral care material 141 through the dispensing gap between the spherical elements 130*a-c* and the side-walls of the corresponding sockets 131*a-c*. It should be understood that in embodiments that have the pressurizer 170, the one-way valve 161 may be omitted because the volume of the reservoir 150 decreases as the piston 171 moves in the axial direction D3. Decreasing the volume of the reservoir 150 prevents the oral care material 141 from flowing from the internal cavity 140 back to the reservoir 150 because of the corresponding decrease in volume of the reservoir 150.

In other embodiments using a movable piston 171 as part of the pressurizer 170, the movable piston 171 can be translated either manually or electronically due to user actuation. For example, a ratchet or drive screw assembly could be used.

Figure 3B:
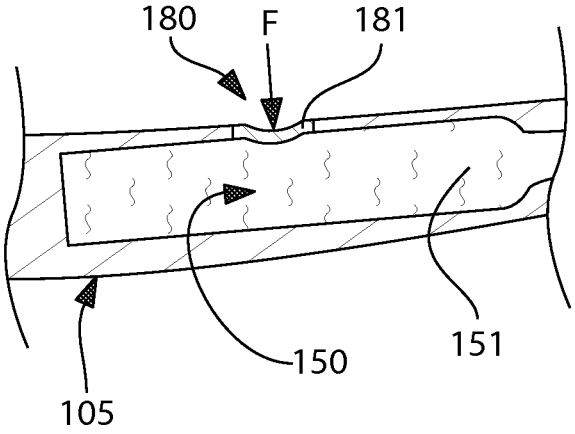
FIG. 3B is a schematic of another embodiment of a pressurizer in the form of a compressible wall that can be used in the toothbrush of FIG. 1 according to another embodiment of the present invention.

Referring now to FIG. 3B, an exemplary pressurizer 180 will be described. The pressurizer 180 is illustrated as a user-operable manual pump. Specifically, the pressurizer 180 is formed by a compressible portion 181 of the body 105 that is formed of a compressible material. The compressible material may be a resilient material, such as an elastomeric material, a flexible plastic material or the like. As the oral care material 141 within the internal cavity 140 becomes depleted, a user can press down on the compressible portion 181 of the body 105 with a transverse force F in the direction of the arrow, thereby forcing the oral care material 141 within the reservoir 150 to flow towards and into the internal cavity 140. Pressing down on the compressible portion 181 with the force F in the direction of the arrow temporarily increases the pressure in the reservoir 150. The compressible portion 181 preferably biases back to its normal structural configuration after the user stops applying the force F to the compressible portion 18 through the use of a proper pressure relief valve. It should be understood that any of the embodiments described herein may also include the one-way valve 161 to prevent the oral care material 141 from flowing back from the internal cavity 140 into the reservoir 150.

Figure 4:
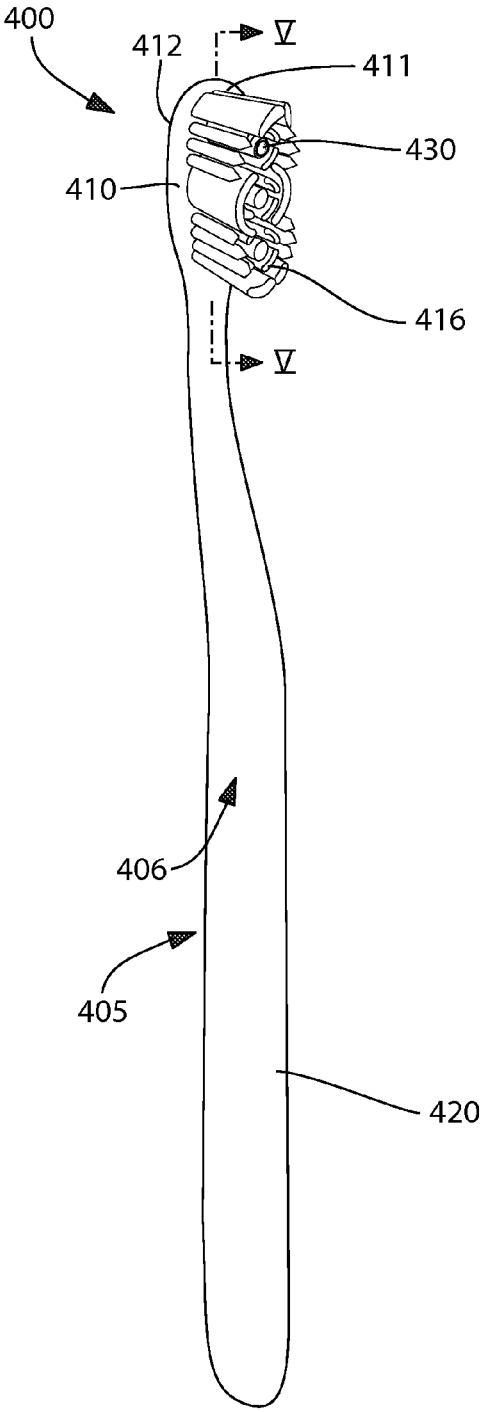
FIG. 4 is a front perspective view of an oral care implement, in the form of a toothbrush, according to a second embodiment of the present invention, wherein the roll-on applicator is located within the tooth cleaning element field on a front surface of a head.
Figure 5:
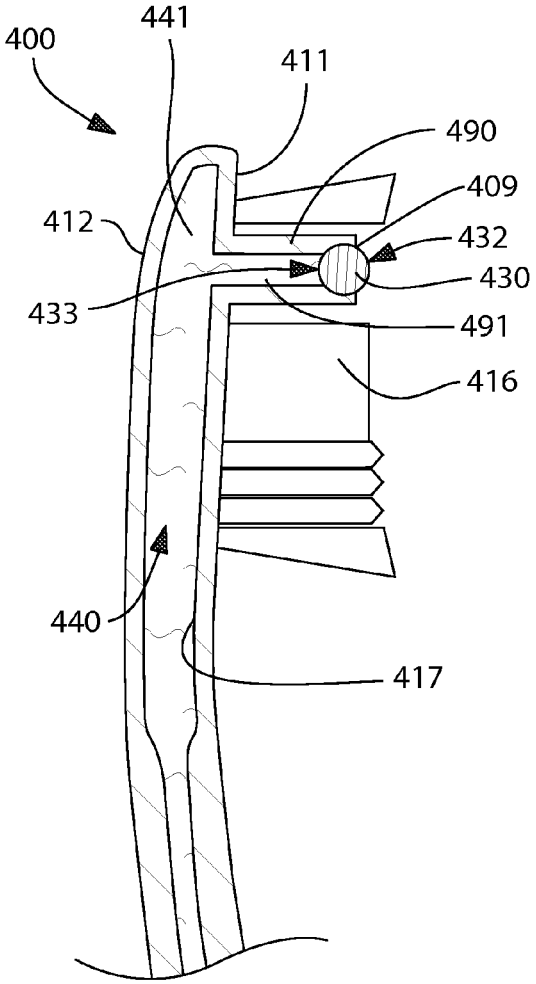
FIG. 5 is a longitudinal cross-sectional view of the toothbrush of FIG. 4 taken along line V-V of FIG. 4.

Referring to FIGS. 4 and 5 concurrently, another embodiment of a toothbrush 400 in accordance with the present invention will be described. The toothbrush 400 is similar to the toothbrush 100 in many regards. Thus, similar features will be similarly numbered with the exception that the 400-series of numbers will be used. It should be understood that features and components of the toothbrush 400 that are not described in detail herein are the same as corresponding features and components of the toothbrush 100.

The toothbrush 400 comprises a body 405 having a handle 420 and a head 410 coupled to an end of the handle 420. The head comprises a front surface 411 and an opposing rear surface 412. Although not illustrated, the rear surface 412 may comprise a soft tissue cleaner, such as the soft tissue cleaner 114 described above. Furthermore, the front surface 411 of the head 410 comprises a plurality of tooth cleaning elements 416 extending outwardly therefrom. The tooth cleaning elements 416 are used for cleaning a user's teeth during an oral hygiene regimen.

The body 405 of the toothbrush 400 comprises an inner surface 417 and an outer surface 406. The inner surface 417 of the body 405 defines an internal cavity 440. In the exemplified embodiment, the internal cavity 440 is positioned within the head 410. However, the invention is not so limited and the internal cavity 440 may be otherwise located within the body 405 of the toothbrush 400. The internal cavity 440 contains an oral care material 441 therein, which may be any of one or a combination of the oral care materials described above.

In addition to the tooth cleaning elements 416, there is an upstanding collar 490 extending from the front surface 411 of the head 410. The upstanding collar 490 is a tubular structure having a cavity 491 therein and an opening 409 in a top end thereof. In the exemplified embodiment, the upstanding collar 490 is a cylindrical-shaped wall. Of course, the invention is not to be so limited and the upstanding collar 490 can take on any other shape and/or be omitted is desired. The cavity 491 is in fluid communication with the internal cavity 440 so that the oral care material 441 can flow from the internal cavity 440 and into the cavity 491. It is preferable that the cavity 491 remains filled with the oral care material 441 as will be described in more detail below.

A roll-on applicator 430 is rotatably mounted within the upstanding collar 490. More specifically, the roll-on applicator 430 is rotatably mounted to the upstanding collar 490 so as to enclose the opening 409. The roll-on applicator 430 can be mounted to the upstanding collar 490 by any means as would be known to persons skilled in the art, including the mating geometry discussed above or the use of an axle or posts. The roll-on applicator 430 is located on the front surface 411 of the head 410 and within the field of tooth cleaning elements 416. The roll-on applicator 430 extends from the head 410 in the same distance as the tooth cleaning elements 416 so that the roll-on applicator 430 can deliver the oral care material 441 to a user's oral surfaces.

The roll-on applicator 430 has an exposed portion 432 that is exposed to the external environment and an internal portion 433 that is in contact with the oral care material 441 within the cavity 491. As described above, the exposed and internal portions 432, 433 are not specific segments of the roll-on applicator 430. Rather, the exposed and internal portions 432, 433 of the roll-on applicator 430 merely refer to the portions of the roll-on applicator 430 that are exposed to the external environment and in contact with the oral care material 441, respectively, at any given time. Furthermore, it should be understood that the roll-on applicator 430 is capable of 360 degrees of rotation about the X, Y and Z axes of a Cartesian coordinate in which the center of the roll-on applicator 430 is the 0-0-0 point.

In the exemplified embodiment, the roll-on applicator 430 comprises a single spherical element that is positioned within the field of tooth cleaning elements 416. Of course, the invention is not so limited and the roll-on applicator 430 may comprise more than one spherical element or it may comprise elements that are shaped other than spherically, such as the cylindrically shaped elements described below with reference to FIG. 6. Furthermore, the positioning of the roll-on applicator 430 on the front surface 412 of the head 410 is in no way limiting of the present invention. In certain embodiment, the upstanding collar 490 can be omitted and the roll-on applicator can be partially embedded in the front surface 411 of the head 410.

As described above, it is preferred that the cavity 491 remain filled with the oral care material 441 at all times. In this way, the internal portion 433 of the roll-on applicator 430 can be in constant contact with the oral care material 441 so that the roll-on applicator 430 can continuously deliver the oral care material 441 from the internal cavity 440 to a user's oral cavity. In order to maintain the cavity 491 filled with the oral care material 441, any of the pressurizers described above may be used. Alternatively, any other method of keeping the cavity 491 filled with the oral care material 441 as may be known to persons skilled in the art can be used.

Figure 6:
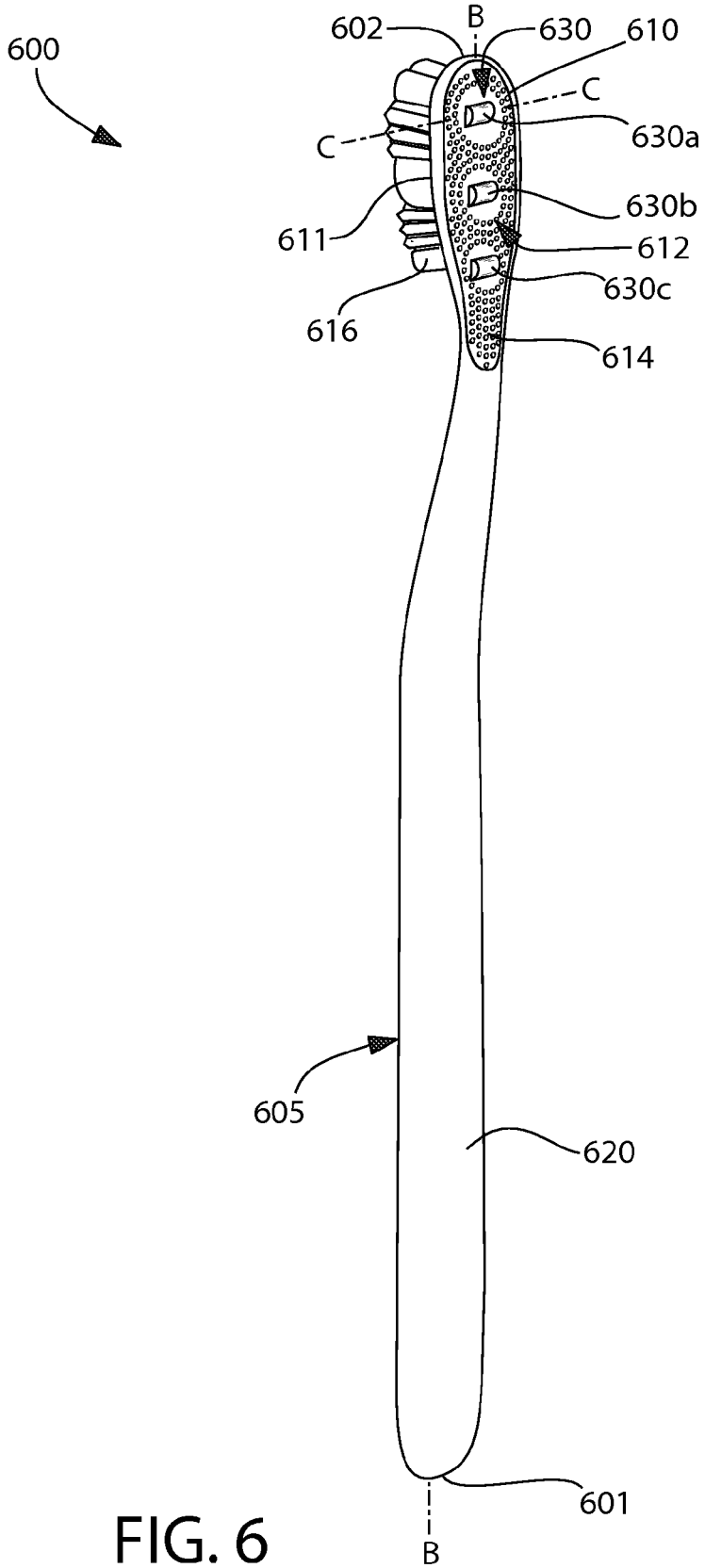
FIG. 6 is a rear perspective view of a toothbrush according to a third embodiment of the present invention, wherein the roll-on applicator is in the form of cylindrical elements.

Referring now to FIG. 6, another embodiment of a toothbrush 600 according to the present invention will be described. The toothbrush 600 has many features that are similar to or the same as features of the toothbrush 100. Thus, similar features will be similarly numbered with the exception that the 600-series of numbers will be used. It should be understood that features and components of the toothbrush 600 that are not described in detail herein are the same as corresponding features and components of the toothbrush 100.

The toothbrush 600 generally comprises a body 605 having a head 610 and a handle 620. The body 605 extends from a proximal end 601 to a distal end 602 along a longitudinal axis B-B. The head 610 comprises a front surface 611 and an opposed rear surface 612. The rear surface 612 comprises a soft tissue cleaner 614, such as the soft tissue cleaner 114 described above. The front surface 611 comprises a plurality of tooth cleaning elements 616 extending outwardly therefrom for engaging a user's teeth during a toothbrushing session.

The toothbrush 600 comprises a roll-on applicator 630. However, rather than spherical elements, the roll-on applicator 630 of the toothbrush 600 comprises a plurality of cylindrical elements, including a first cylindrical element 630*a*, a second cylindrical element 630*b* and a third cylindrical element 630*c*. The details of the cylindrical elements 630*a-c* will be described below with reference to the first cylindrical element 630*a*. However it should be understood that the details discussed herein regarding the first cylindrical element 630*a* is equally applicable to the second and third cylindrical elements 630*b*, 630*c*.

The first cylindrical element 630*a* comprises a longitudinal axis C-C that is perpendicular or transverse to the longitudinal axis B-B. The first cylindrical element 630*a* is rotatably mounted to the body 605 so as to be capable of 360 degrees of rotation about the longitudinal axis C-C (which is also the axis of rotation of the first cylindrical element 630*a*). In the exemplified embodiment, the first cylindrical element 630*a* is rotatably mounted to the rear surface 612 of the head 610. Of course, as has been described above, the invention is not so limited and the cylindrical elements 630*a-c* can be mounted at any location on the body 605 including, for example, on the front surface 611 of the head 610 or on the handle 620. The cylindrical elements 630*a-c* act and function in a manner similar to the spherical elements 130*a-c* of the roll-on applicator 130 discussed above except that the cylindrical elements 630*a-c* are more limited in their rotational degrees of freedom. Thus, the entire description of the oral care material delivery of the spherical elements 130*a-c* is fully applicable to the cylindrical elements 630*a-c* of the roll-on applicator 630.

A method of applying an oral care material to an oral surface of a user will now be described. The method will be described with reference to the reference numerals from the toothbrush 100. However, it should be understood that the other embodiments can also be used with the method. The toothbrush 100 with the roll-on applicator 130 rotatably mounted thereto is positioned so that the roll-on applicator 130 is in contact with the user's oral surface. Then, the toothbrush 100 is used such that relative movement between the toothbrush 100 and the oral surface of the user is created while maintaining the roll-on applicator 130 in contact with the user's oral surface. As such, the roll-on applicator 130, or more specifically the spherical elements 130*a-c* of the roll-on applicator 130, are caused to rotate relative to the body 105 of the toothbrush 100 to thereby deliver the oral care material 141 from the internal cavity 140 to the user's oral surface. The relative movement described above can be achieved from a normal toothbrushing movement, such as a back-and-forth axial movement along the longitudinal axis B-B or a circular motion as would be known to persons skilled in the art. By using the toothbrush 100 as described above, the rotation of the spherical elements 130*a-c* of the roll-on applicator 130 cause the oral care material 141 within the internal cavity 140 to be delivered to the exposed portion 132*a-c* of the spherical elements 130*a-c* of the roll-on applicator 130. In turn, the exposed portions 132*a-c* of the spherical elements 130*a-c* of the roll-on applicator 130 contact the oral surface of the user to apply the oral care material 141 to the user's oral surfaces.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments. For example, in certain embodiments, the delivery of the oral care fluid from the reservoir to the applicator can be supplemented by mechanical action if desired.

What is claimed is:

1. An oral care implement comprising:

a body comprising a handle, a head coupled to the handle, and an internal cavity containing an oral care material;

a roll-on applicator rotatably mounted to the body, such that the oral care material is delivered from the internal cavity to an exposed portion of the roll-on applicator due to rotation of the roll-on applicator; and a field of tooth cleaning elements extending from a front surface of the head, wherein the roll-on applicator is located on at least one of: (1) a rear surface of the head opposite the front surface; and (2) the front surface of the head and within the field of tooth cleaning elements.

2. The oral care implement according to claim 1 wherein the exposed portion of the roll-on applicator protrudes from an outer surface of the body and an internal portion of the roll-on applicator contacts the oral care material within the internal cavity.

3. The oral care implement according to claim 1 wherein the roll-on applicator comprises at least one spherical element rotatably mounted to the body.

4. The oral care implement according to claim 3 wherein the at least one spherical element is mounted in a socket formed in the body.

5. The oral care implement according to claim 1 wherein the roll-on applicator comprises at least one cylindrical element rotatably mounted to the body.

6. The oral care implement according claim 1 wherein the roll-on applicator is located on a longitudinal axis of the oral care implement.

7. An oral care implement comprising:

a body comprising a handle, a head coupled to the handle, and an internal cavity containing an oral care material;

a roll-on applicator rotatably mounted to the body, such that the oral care material is delivered from the internal cavity to an exposed portion of the roll-on applicator due to rotation of the roll-on applicator; and a soft tissue cleaner comprising one or more protuberances, the roll-on applicator positioned within the soft tissue cleaner.

8. The oral care implement according to claim 1 wherein the internal cavity is located within the head.

9. The oral care implement according to claim 1 further comprising a pressurizer that pressurizes the oral care material within the internal cavity so that the oral care material maintains contact with the roll-on applicator.

10. The oral care implement according to claim 9 wherein the pressurizer comprises one of a movable piston or a user-operable pump.

11. The oral care implement according claim 9 further comprising a reservoir containing the oral care material in the body, the reservoir being in fluid communication with the internal cavity.

12. The oral care implement according to claim 11, wherein the pressurizer pressurizes the oral care material within the reservoir, thereby supplying the oral care material from the reservoir to the internal cavity to maintain contact with the roll-on applicator.

13. The oral care implement according to claim 11 further comprising a one-way valve operably coupled between the reservoir and the internal cavity that allows flow of the oral care material from the reservoir to the internal cavity while prohibiting flow of the oral care material from the internal cavity to the reservoir.

14. The oral care implement according to claim 1 wherein the roll-on applicator is rotatably mounted to the body so as to be capable of at least 360 degree rotation about an axis extending substantially perpendicular to a longitudinal axis of the oral care implement.

15. An oral care implement comprising:

a body comprising a handle, a head coupled to the handle, and an internal cavity containing an oral care material;

a roll-on applicator rotatably mounted to the body, such that the oral care material is delivered from the internal cavity to an oral surface of a user due to rotation of the roll-on applicator; and a field of tooth cleaning elements extending from a front surface of the head, wherein the roll-on applicator is located on at least one of: (1) a rear surface of the head opposite the front surface; and (2) the front surface of the head and within the field of tooth cleaning elements.

16. The oral care implement according to claim 15 wherein an exposed portion of the roll-on applicator protrudes from an outer surface of the body and an internal portion of the roll-on applicator contacts the oral care material within the internal cavity.

17. The oral care implement according to claim 15 wherein the roll-on applicator comprises one or more spherical elements rotatably mounted to the body.

18. The oral care implement according to claim 17 wherein each of the one or more spherical elements is mounted in a socket formed in the body.

19. An oral care implement comprising:

a body comprising a handle, a head coupled to the handle, and an internal cavity containing an oral care material;

a roll-on applicator rotatably mounted to the body, such that the oral care material is delivered from the internal cavity to an oral surface of a user due to rotation of the roll-on applicator; and a soft tissue cleaner comprising one or more protuberances, and the roll-on applicator positioned within the soft tissue cleaner.

20. The oral care implement according to claim 15 further comprising a pressurizer disposed within the body, the pressurizing being capable of pressurizing the oral care material within the internal cavity so that the oral care material remains in fluid communication with the roll-on applicator.

* * * * *